US010820733B2

(12) United States Patent
Kaiserman et al.

(10) Patent No.: US 10,820,733 B2
(45) Date of Patent: Nov. 3, 2020

(54) DELIVERY COMPARTMENT

(71) Applicant: Lennar Ventures, Miami, FL (US)

(72) Inventors: David J. Kaiserman, Miami Beach, FL (US); James Kenneth Petersen, Plantation, FL (US)

(73) Assignee: Lennar Ventures, Miami, FL (US)

( * ) Notice: Subject to any disclaimer, the term of this patent is extended or adjusted under 35 U.S.C. 154(b) by 0 days.

(21) Appl. No.: 16/258,043

(22) Filed: Jan. 25, 2019

(65) Prior Publication Data

US 2019/0231106 A1 Aug. 1, 2019

Related U.S. Application Data

(60) Provisional application No. 62/684,624, filed on Jun. 13, 2018, provisional application No. 62/622,813, filed on Jan. 26, 2018.

(51) Int. Cl.

| | |
|---|---|
| ***A47G 29/14*** | (2006.01) |
| ***A47G 29/20*** | (2006.01) |
| ***F25D 13/04*** | (2006.01) |

(52) U.S. Cl.

CPC ..... *A47G 29/141* (2013.01); *A47G 29/20* (2013.01); *F25D 13/04* (2013.01); *A47G 2029/144* (2013.01); *A47G 2029/145* (2013.01); *A47G 2029/147* (2013.01); *A47G 2029/149* (2013.01)

(58) Field of Classification Search

None

See application file for complete search history.

(56) References Cited

U.S. PATENT DOCUMENTS

| | | | | |
|---|---|---|---|---|
| 6,289,684 | B1 * | 9/2001 | Guidry, II | F25D 19/003 62/229 |
| 9,700,168 | B1 * | 7/2017 | Evans | A47G 29/141 |
| 2001/0035703 | A1 * | 11/2001 | Scholefield | A47G 29/141 312/242 |
| 2002/0032613 | A1 * | 3/2002 | Buettgenbach | G06Q 10/08 705/26.8 |
| 2003/0006275 | A1 * | 1/2003 | Gray | A47G 29/14 232/19 |
| 2004/0263029 | A1 * | 12/2004 | Scholefield | A47G 29/141 312/242 |
| 2006/0179724 | A1 * | 8/2006 | Lee | A47G 29/141 52/79.1 |
| 2009/0187274 | A1 * | 7/2009 | Higham | G07C 9/00912 700/237 |

(Continued)

*Primary Examiner* — Henry T Crenshaw

(74) *Attorney, Agent, or Firm* — Buchalter, a professional corp.; Kari L. Barnes

(57) ABSTRACT

A delivery compartment comprising one or more cavities and one or more doors, such that access to each of the cavities is granted separately. The delivery compartment may include a lock preventing access to the one or more cavities unless authorization is obtained. The delivery compartment may be integrated into a wall, or other structure, associated with a building, such as a residential home or business. The delivery compartment may be built into or otherwise configured into a door for the building such that certain panels allow access to the one or more cavities for delivery of goods while other panels allow access to an interior space of the building itself. The delivery compartment may include environmental control capabilities for one or more of its cavities.

20 Claims, 15 Drawing Sheets

(56) References Cited

U.S. PATENT DOCUMENTS

| | | | | |
|---|---|---|---|---|
| 2012/0158606 | A1* | 6/2012 | Moudy | G06Q 10/083 705/332 |
| 2014/0190081 | A1* | 7/2014 | Wanjohi | A47G 29/126 49/25 |
| 2016/0201379 | A1* | 7/2016 | Dutra | E05G 1/005 312/204 |
| 2018/0228310 | A1* | 8/2018 | Enobakhare | A47G 29/1207 |
| 2018/0260777 | A1* | 9/2018 | Judge | G06Q 10/0836 |
| 2018/0290764 | A1* | 10/2018 | McMillian | B64D 45/04 |

* cited by examiner

DELIVERY COMPARTMENT

CROSS REFERENCE TO RELATED APPLICATIONS

This application claims the benefit of U.S. Provisional Patent Application Ser. No. 62/622,813, filed on Jan. 26, 2018, entitled "DELIVERY COMPARTMENT," which is hereby incorporated by reference in its entirety into this application. This application claims the benefit of U.S. Provisional Patent Application Ser. No. 62/684,624, filed on Jun. 13, 2018, entitled "DELIVERY COMPARTMENT," which is hereby incorporated by reference in its entirety into this application.

BACKGROUND

1. Field

The present invention relates generally to apparatus or methods associated with shipment or delivery services. More particularly, the present invention relates to a device associated with or integrated with a building, such as a home, for allowing selective access to one or more cavities therein for storage of deliveries.

2. Description of the Related Art

The way consumers shop and receive goods is changing. Conventionally, consumers would obtain desired goods, such as groceries or other physical items by traveling to a store or retail establishment, locating the desired items, paying for those items at the store or retail establishment, and subsequently bringing the items directly with them to their homes or businesses. However, remote shopping (telephone, catalog, etc.) and especially the advent of online shopping (e.g., via the Internet), has significantly modified the shopping, selection, and delivery paradigm for these goods. With increased frequency, consumers are shopping for and selecting goods for purchase remotely and having other individuals or businesses retrieve, ship, and/or deliver the items to them.

Although convenient for many consumers, this reliance upon other individuals or businesses to deliver the goods can bring new issues or inconveniences to the shopping experience. For example, the purchased goods may be delivered to a destination when the consumer, or other receiver of the goods, is not available at that destination, resulting in the goods being left at the destination (e.g., on a front porch or doorstep when the homeowner is not at home) until the consumer or other receiver is able to retrieve them. The delivered goods are therefore exposed to the environment and elements, the local wildlife, and/or the local human population and can result in the goods being damaged, stolen, or otherwise interfered with. In addition, the delivered goods may require special care or conditions, such as refrigeration or freezing, that may be difficult to accommodate when delivered to a destination, such as a porch, doorstep, or driveway. As remote shopping becomes increasingly popular, these issues or inconveniences will only be exacerbated.

Accordingly, a new method, system, and/or apparatus for delivery of goods is desired. Ideally, the method, system and/or apparatus for delivery of goods would be cost effective, convenient, and would aid in solving or aiding in the reduction of one or more of the issues or inconveniences discussed above, such as by preventing damage, theft, and/or helping to accommodate any special care, conditions, or instructions that may be associated with a particular good.

SUMMARY

A method for delivery or a delivery apparatus is disclosed that is configured to provide a space to accommodate the delivery of goods at a location. The delivery apparatus may be a device having a compartment for providing the space to accommodate delivered goods at a home. The delivery compartment may have an opening, a door covering the opening, and walls to define an interior cavity. The door may provide access to the interior cavity such that delivered objects may be placed and stored in the interior cavity.

In an exemplary embodiment, the interior cavity may be partitioned. The partitioned cavity may define separate cavities within the delivery compartment. Each of the separate cavities may each have an opening and a door to permit selective entry into one cavity or more of the cavities and not one or more of the other cavities. Each of the different cavities may define a different environment. For example, a cavity may include humidity and/or temperature controls such that the temperature of one cavity may be maintained colder than another cavity. The separate cavities may therefore be insulated.

In an exemplary embodiment, the delivery compartment may be integrated into a wall of a building, such as a house, apartment, business, etc. The opening may provide access to the interior cavity from an exterior of the building.

In an exemplary embodiment, the interior cavity may be accessed on opposing sides such that a delivery person may access the cavity from an exterior of the home, and a resident may access the cavity from an interior of the home or garage. Access to the opposing sides may be controlled in different way. For example, the exterior side may include a lock or other access requirement before access is granted, while the interior side may not include a lock and may permit a resident to simply open the compartment.

In one exemplary embodiment, a delivery compartment may include a wall having a first surface along an exterior of a building and having a second surface along an interior of the building, the wall defining an interior cavity between the first surface and the second surface for storage of goods, a first opening on the first surface providing access to the interior cavity, a second opening on the second surface providing access to the interior cavity, and a first barrier configured to open for providing access to the interior cavity of the wall and configured to close for covering the first opening of the wall.

In another exemplary embodiment, a delivery compartment in a wall of a building may include a base configured to be at least partially contained within the wall of the building, a structure containing an interior cavity and configured to interface with the base for moving with respect to the base, the structure having a first position wherein the interior cavity is fully contained within the wall of the building and a second position wherein the interior cavity is at least partially not contained within the wall of the building, and a lock associated with the structure for selectively permitting the structure to be moved relative to the base, wherein the lock is configured to prevent the structure from moving from the first position if access to the interior cavity is not authorized.

In still another exemplary embodiment, a method for authorization by a user of delivery of a package may include: providing a delivery compartment for storage of the package, the delivery compartment including an interior cavity for the storage of the package, a barrier for selectively allowing access to the interior cavity, and a processor for controlling the access to the interior cavity by the barrier. The method may also include determining, using the processor, when delivery of the package is desired, notifying, using the processor, the user that delivery of the package is desired, receiving, using the processor, input from the user, and allowing access to the interior cavity of the delivery compartment based upon the input from the user. The method may also include automatically preventing access to the interior cavity after the package is stored in the interior cavity of the delivery compartment.

DETAILED DESCRIPTION

In the following description of preferred embodiments, reference is made to the accompanying drawings which form a part hereof, and in which it is shown by way of illustration specific embodiments in which the invention can be practiced. It is to be understood that other embodiments can be used and structural changes can be made without departing from the scope of the embodiments of this invention.

An exemplary delivery compartment may provide a space to accommodate delivered goods at the home. The delivery compartment may have an opening, a door covering the opening, and walls to define an interior cavity. The door may provide access to the interior cavity such that delivered objects may be placed and stored in the interior cavity.

Although embodiments of the invention may be described and illustrated herein in terms of a delivery compartment for a home, it should be understood that embodiments of this invention are not so limited, but are additionally applicable to other structures such as office buildings, apartments, etc. Furthermore, although embodiments of the invention may be described and illustrated herein in terms of a wall or door compartment, it may be located anywhere, such as in a standalone unit, a wall, a door, a garage, a shed, etc. For example, although the exemplary embodiment describes a delivery compartment having a cavity accessed on two sides of the delivery compartment, the compartment may only have a single access. The delivery compartment may be integrated into the home or may be a standalone unit. The delivery compartment may also be configured as a retrofit unit. For example, it may be configured to rest within a window sill or be positioned within an exterior wall of a home such as by making a hole in a wall and positioning the delivery compartment within the hole of the wall.

Figure 1:
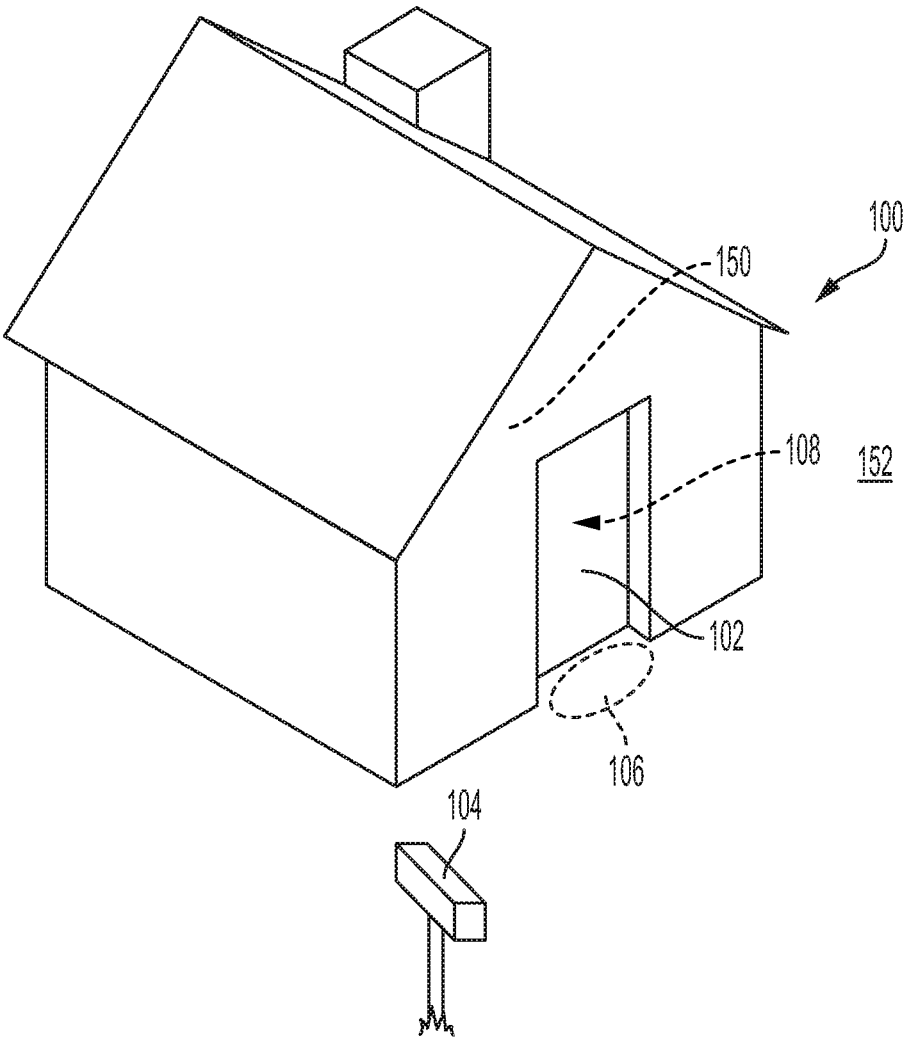
FIG. 1 illustrates an exemplary home having a door in the context of delivery of goods.

FIG. 1 illustrates an exemplary home 100 where delivery of goods may be made. Although the home 100 is specifically illustrated as the structure where delivery of goods may be made in FIG. 1, any other structure and/or other location for delivery (e.g., apartment, condo, business, office complex, lobby, other location, etc.) may be applicable in an alternative embodiment. The home 100 may have a door 102 or other barrier of entry separating individuals outside of the structure from entering the structure, for example, without permission. Thus, the home 100 may enclose an interior space 150 within an interior of its structure that is separated from an exterior space 152 that is outside of the structure. The door 102 or other barrier permits residents or other individuals (e.g., those with permission) to enter the interior space 150 of the home 100 from the exterior space 152.

Conventionally, delivery of goods to the home 100 may be by mail or other courier service that leaves the goods in a mail box or other container 104 (e.g., a structure that is relatively small in size) that is positioned at some location in the exterior space 152 of the home 100. However, a particular package or delivery item may be large in size or shaped in such a way that it is not capable of fitting within the mail box or other container 104. In addition, as deliveries become more pervasive, the conventional (small) mail box or other container 104 may be unable or undesirable for accommodating the size and/or amount of such deliveries. Accordingly, the deliveries of goods in such circumstances may also conventionally be left at or near 106 the door 102 of the home 100. As discussed in greater detail herein, in one embodiment, a compartment or space 108 that exists at least partially between an exterior surface of the home 100 and the interior space 150 of the home 100 may be accommodated to allow for delivery of items while also affording protection to those items from non-permitted individuals and/or providing other beneficial features. In other embodiments described in greater detail herein, a compartment or space may exist via a structure that is integrated with, connected with, or otherwise disposed outside of the exterior surface of the home 100

Figure 2:
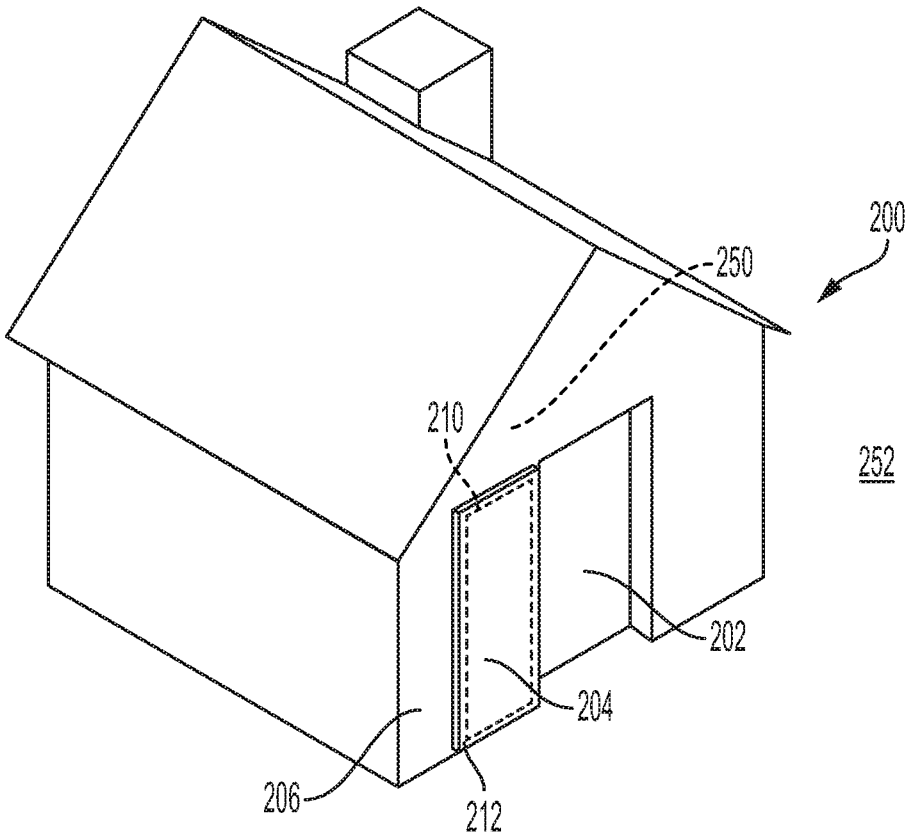
FIG. 2 illustrates an exemplary building having a delivery compartment according to exemplary embodiments described herein.

FIG. 2 illustrates an exemplary home 200 having an exemplary delivery compartment 204 that is positioned or disposed adjacent to a door 202 of the home 200. The delivery compartment may allow for receipt of goods according to embodiments described herein. As previously discussed, although the home 200 is specifically illustrated as the structure where delivery of goods may be made in FIG. 2, any other structure or other location for delivery (e.g., apartment, condo, business, office complex, lobby, other location etc.) may be applicable in an alternative embodiment. As discussed in greater detail below, the delivery compartment 204 may be a structure that is integrated with the exterior of the home 200 (e.g., is constructed with the same or similar materials and/or interfaces with the materials making up the exterior of the home 200). In an alternative embodiment, the delivery compartment 204 may be a structure that is coupled with the exterior of the home 200 (e.g., is constructed of the same or different materials as the exterior of the home, but is connected with the exterior of the home, for example, via nails, bolts, screws, adhesives, etc.). In still another embodiment, the delivery compartment 204 may be a structure that is not connected with the exterior of the home 200, but is a structure that is merely positioned at a desired location (e.g., adjacent to a doorway and/or along a side of the home 200).

The delivery compartment 204 may provide an opening, cavity, or space 210 (e.g., within an interior of the delivery compartment 204) to accommodate delivered goods at the home 200. In certain embodiments, in addition to providing merely the opening, cavity, or space 210 for accommodating receipt of the delivered goods, the delivery compartment 204 may also help protect the goods, or provide additional benefits for the care of the goods, as discussed in greater detail herein. In one embodiment, the opening, cavity, or space 210 is formed via a plurality of walls or other structural elements (e.g., that make up the delivery compartment 204) for defining the shape of the opening, cavity, or space 210. The opening, cavity, or space 210 may be disposed behind one or more accessible barriers, doors, or panels 212 that may provide access to the opening, cavity, or space 210 by being configured to cover or reveal the opening, cavity, or space 210.

As shown, the delivery compartment 204 may be integrated into an exterior wall 206 (or other structural component) of the home 200. In one embodiment, the delivery compartment 204 may have an exterior wall or surface the barrier or door 212) that exists in the plane or substantially within the plane of the exterior wall 206 of the home. Although obscured from view in FIG. 2, the delivery compartment 204 may also have an interior wall or surface that exists in the plane or substantially within the plane of an interior wall of the home 200. In such an embodiment, the opening, cavity, or space 210 of the delivery compartment 204 may be substantially the thickness measured from the plane of the exterior wall 206 to the plane of the interior wall of the home 200. In an alternative embodiment, a delivery compartment may be integrated with or built based upon an extension of a wall of a home. In still another embodiment, a delivery compartment may be recessed or project outwardly or inwardly, with respect to a plane of either the exterior or interior walls of a home.

The delivery compartment 204 may have an exterior access such that entry into the opening, cavity, or space 210 may be permitted from an individual located at an exterior space 252 that is outside of the home 200 (e.g., via the barrier or door 212). The barrier or door 212 may provide an access restriction or selectable access (e.g., may be capable of being locked so that only an individual with the proper key, key code, wireless permission, or other form of access) in order to keep the opening, cavity or space 210 secure from unauthorized individuals (e.g., individuals who are not the owner or renter of the home 200, individual, who are not the courier delivering the item to the home, etc.). Such a lock may be a simple latch that keeps the barrier or door 212 in a closed position. The lock may require a key to unlock. The key may be a physical key. The key may be a code or combination that is entered, such as through a smart lock interface (including but not limited to a keypad, mobile application wirelessly communicating with the lock, etc.). For example, in such a case, a delivery personnel may be given a combination to open the lock by a resident, owner or purchaser when a purchase is made. The key may also be through an application and provided remotely by the resident upon a request from a delivery personnel. In this case, the delivery personnel may press a button or other communication mechanism of, at, or near the delivery compartment 204. Access may be granted by scanning the delivery barcode on the package. The communication mechanism may be communicatively coupled to a transmitter and receiver to send and receive messages to and from the resident, owner, or purchaser. The communication mechanism may therefore send a message to the resident, owner, or purchaser and receiving a confirmation form the resident, owner, or purchaser that access is granted. Upon an indication by the resident, owner, or purchaser that access is granted, the lock is opened.

The delivery compartment 204 may also have an interior access such that entry into the opening, cavity, or space 210 may be obtained from an interior space 250 located inside of the home 200 (e.g., via an interior door or panel that provides access to the opening, cavity or space 210). The interior door may provide selectable access or may, in certain embodiments, allow unfettered access to the opening, cavity or space 210. For example, it may be desired that anyone who has access to the interior space 250 of the home 200 also have access to the opening, cavity, or space 210 when within the interior of the home 200 without having to be subsequently or selectably authorized (e.g., via a lock) to access the opening, cavity, or space 210.

In an exemplary embodiment, the delivery compartment 204 may have a plurality of walls that define the interior cavity, an exterior door (such as the barrier or door 212, covering an opening on an exterior side of the home), and an interior door covering an opening on an interior side of the home. In an exemplary embodiment, the exterior door may be configured to look like an extension of the exterior wall of the home (e.g., if the exterior wall 206 of the home 200 is manufactured of siding, brick, stucco, wood, etc., the exterior door may be similarly manufactured of siding, brick, stucco, wood, etc., respectively, and/or may be manufactured of a material that looks like or similar to the above-mentioned materials) such that the exterior door blends in with the exterior wall 206. The exterior door and/or other walls or surfaces of the delivery compartment 204 may have any aesthetic appearance and/or be made of any of a variety of materials depending on the look desired. In an exemplary embodiment, the exterior door may be configured (e.g., positioned and/or manufactured of particular materials) to mirror or match with the front door of the home, such that it appears as a double-door entryway, where one side of the double-door provides access to the delivery compartment 204 and the other side of the double-door provides access into the interior space 250 for entry into the home 200.

Any of a variety of possible configurations for orienting the delivery compartment 204 with respect to exterior or interior walls of the home 200 may be made. For example, in an exemplary embodiment, the interior side of the delivery compartment 204 may be flush with an interior wall or surface of the home 200, while an exterior side of the delivery compartment 204 extends outwardly past an exterior wall of the home 200. In another exemplary embodiment, the interior side of the delivery compartment 204 may be flush with an interior wall of the home 200, while an exterior side of the delivery compartment 204 is recessed inwardly from an exterior wall of the home 200. In another exemplary embodiment, the exterior side of the delivery compartment 204 may be flush with an exterior wall of the home 200, while the interior side of the delivery compartment 204 extends outwardly past an interior wall of the home. In still another exemplary embodiment, the exterior side of the delivery compartment may be flush with an exterior wall of the home, while an interior side of the delivery compartment is recessed inwardly from an interior wall of the home. In still another exemplary embodiment, both the exterior side and the interior side of the delivery compartment may be flush with the exterior wall and the interior wall of the home, respectively.

In one exemplary embodiment, the delivery compartment 204 may have its opening, cavity or space 210 fully or partially segregated into a plurality of compartments. A door or panel that allows access to the segregated opening, cavity or space 210 may correspondingly be segregated or may comprise a plurality of doors or panels (e.g., a portion of the door or panel or one of the plurality of doors or panels allows access to one of the plurality of compartments while other of the plurality of compartments are not accessible via that portion of the door or panel or that one of the plurality of doors or panels. In one embodiment, an outer surface door may be a thin layer that covers the surface of the delivery compartment 204 to match or create a desired aesthetic. For example, the outer surface door may be configured to look like an interior or exterior wall of the home, a window, a door, or anything else. One or more inner surface doors may then provide access to one or more cavities within the delivery compartment. Therefore, a user may open the outer surface door to provide access to the inner surface door(s). The inner surface doors then provide access to individual cavities within the delivery compartment. The outer surface door may also be used to cover control panels, access panels, locks, cameras, lights, or combinations thereof. The movement of the outer surface door may be a trigger to turn on or turn off different features of the delivery compartment, such as notifications of delivery, cameras, lights, or combinations thereof.

Figure 3:
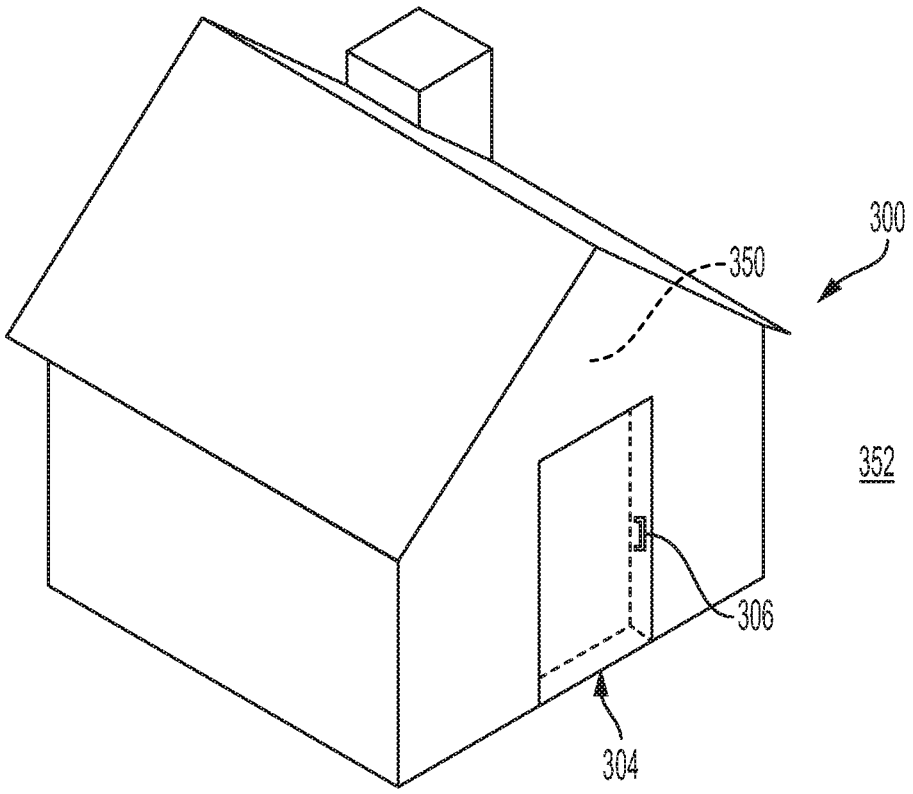
FIG. 3 illustrates an exemplary building having a delivery compartment according to embodiments described herein.

FIG. 3 illustrates an exemplary home 300 having a delivery compartment 304 according to embodiments described herein. As previously discussed, although the home 300 is specifically illustrated as the structure where delivery of goods may be made in FIG. 3, any other structure or other location for delivery (e.g., apartment, condo, business, office complex, lobby, other location etc.) may be applicable in an alternative embodiment. The delivery compartment 304 may include features that are the same as or similar to those previously discussed. Similar to the previous discussions, the exemplary delivery compartment 304 may provide a space to accommodate delivered goods at the home 300 and may additionally be configured to protect the delivered goods and may have an opening, cavity, or space formed via one or more walls, and a door providing access to the opening, cavity, or space.

As shown, the delivery compartment 304 may be integrated into a door that is placed or disposed in an opening or entry of the home 300 that would conventionally be filled by a conventional door (e.g., a front door). In one embodiment, the delivery compartment 304 may be made to look like a door and/or have one or more features of a door, such as a doorknob or handle 306, and/or a locking system, peep hole, window, etc., but additionally contain an interior cavity that may be used for the storage of goods, the same or similar to embodiments previously discussed. The delivery compartment 304 may have an exterior wall in the plane or approximate the plane of the exterior wall of the home and an interior wall in the plane or approximate the plane of the interior wall of the home, the same or similar embodiments previously discussed. The delivery compartment 304 may have a greater depth or thickness than that of a conventional door in order to define the interior cavity for the storage of goods.

The delivery compartment 304 may be coupled to the home 300 such that the delivery compartment may provide access to the interior of the home 300 independent of the delivery compartment 304 providing access to the interior cavity used for the storage of goods. For example, the delivery compartment 304 may be manufactured with a first hinge or first set of hinges that allows the delivery compartment to be opened for providing access from an exterior space 352 of the home 300 to an interior space 350 of the home 300. The delivery compartment 304 may also or alternatively be manufactured with a second hinge or second set of hinges that allows the delivery compartment 304 to be opened for providing access to the interior cavity of the delivery compartment 304 for the storage or retrieval of goods therein, but without providing access to the interior space 350 of the home 300. This may be desirable in situations where an individual is authorized to access the interior cavity of the delivery compartment 304, but is not authorized to access the interior space 350 of the home (e.g., an individual associated with a courier service for delivery one or more goods, but whom otherwise has no relationship with the home 300 so should not be permitted within the home 300).

Various configurations of one or more delivery compartments may be incorporated into a door for the home 300 or otherwise coupled with a home, as previously discussed. For example, the door may be a double-door arrangement. In such an example, one or more delivery compartments may be incorporated with one of the two double-doors while the other one of the two double-doors does not contain any delivery compartments (e.g., merely provides access to the interior space 350 of the home 300 from the exterior space 352). In another example, one or more delivery compartments may be incorporated into both of the double doors. Greater or fewer amounts of doors with or without delivery compartments may be provided in alternative embodiments. For example, it may be desirable for multiple, independently authorizable delivery compartments or cavities for storage of goods to be associated with a single door or plurality of doors of a home. In one such example, a delivery compartment may be integrated into a door for a home that has two separated or segregated cavities therein for storage of goods. Access to each of the two separated or segregated cavities of the delivery compartment may be setup, controlled, or otherwise authorized independent of one another (e.g., access to the first cavity is provided by first authorization credentials whereas access to the second cavity is provided by second authorization credentials). In certain embodiments, particular authorization credentials may be setup or used to access more than one cavity or storage space of a delivery compartment (e.g., a "master" set of credentials may be desired that allow access to a plurality of cavities of a delivery compartment).

Figure 4:
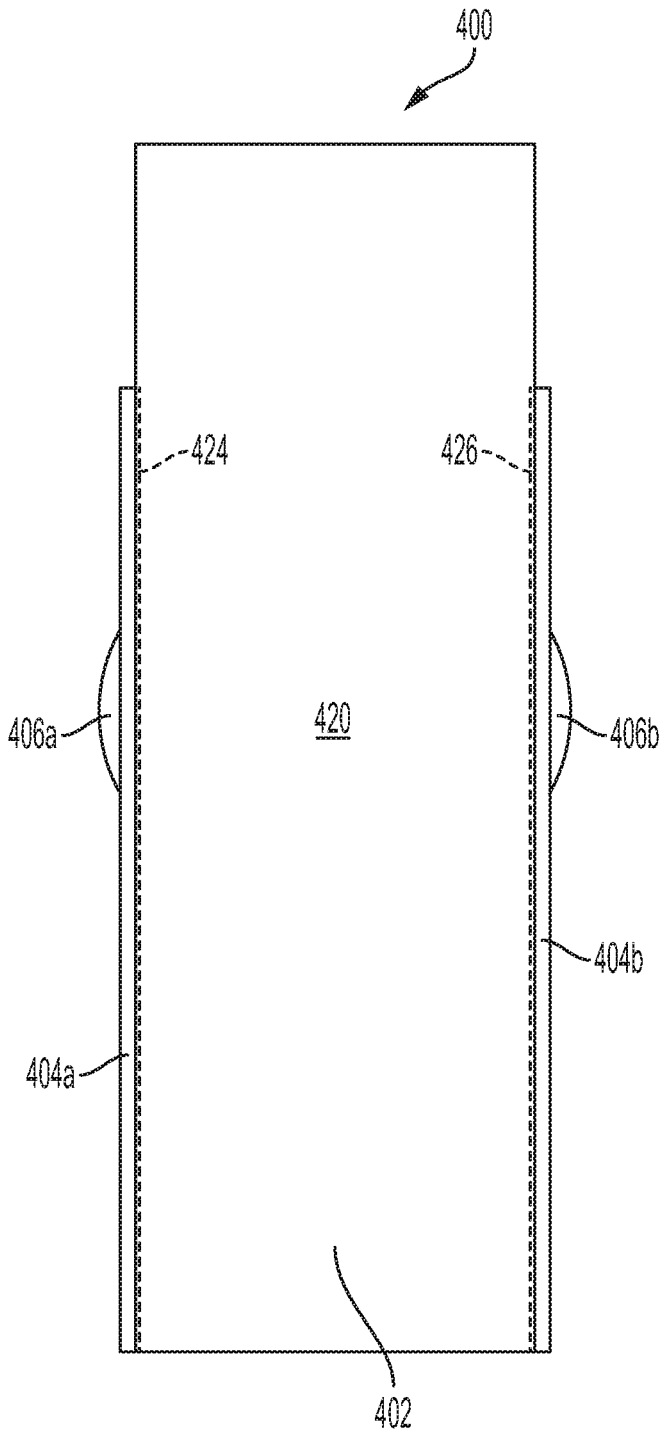
FIG. 4 illustrates an exemplary delivery compartment according to embodiments described herein.

FIG. 4 illustrates an exemplary delivery compartment 400 according to embodiments described herein. The delivery compartment 400 may have at least one wall 402 that (at least n part) defines an interior cavity 420 of the delivery compartment 400, a first opening 424, a second opening 426, a first door 404*a* covering the first opening 424, and a second door 404*b* covering the second opening 426. The doors (404*a*, 404*b*) may provide access to the interior cavity 420. As shown, the delivery compartment 400 may have the first door 404*a* opposite from the second door 404*b* (e.g., the first door 404*a* may be in or substantially within or parallel to a plane on an exterior wall of a home while the second door 404*b* may be in or substantially within or parallel to a plane on an interior wall of a home). The doors (404*a*, 404*b*) may include one or more opening mechanisms thereon (e.g., the first door 404*a* may have a corresponding first opening mechanism 406*a* while the second door 404*b* may have a corresponding second opening mechanism 406*b*). The opening mechanisms may be the same or different for the different doors. In certain embodiments, greater or fewer opening mechanisms may be associated with the first and/or second doors (404*a*, 404*b*).

Exemplary embodiments include any combination of openings and doors in a variety of configurations. For example, the delivery compartment 400 may have a single opening and/or a single door on a side of the delivery compartment 400. More than one side of the delivery compartment 400 may have more than one opening and/or more than one door. For example, two sides of the delivery compartment 400 may have an opening and a door. The two sides may be on opposite sides of the delivery compartment 400. The two sides may be on adjacent sides or a same side of the delivery compartment 400.

Figure 5:
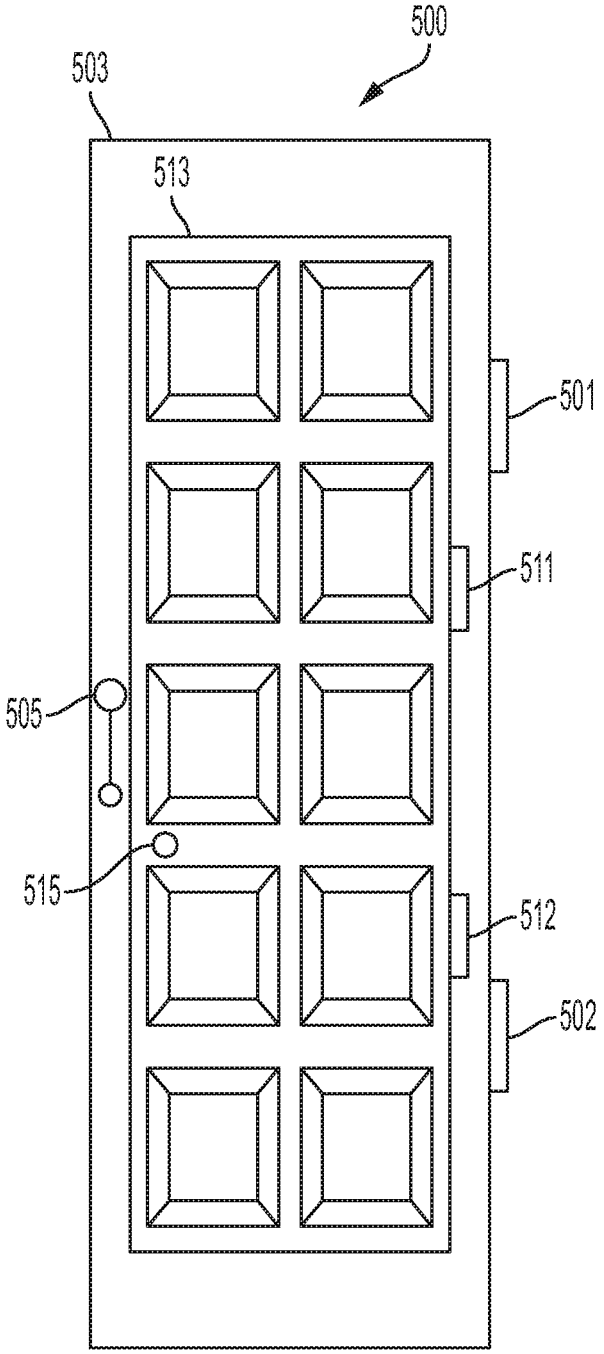
FIG. 5 illustrates an exemplary delivery compartment according to embodiments described herein.

FIG. 5 illustrates an exemplary embodiment of a delivery compartment 500 that is associated with a door. The delivery compartment 500 may include features that are the same as or similar to those previously discussed, such as the delivery compartment 204, 304, and/or 400, according to embodiments described herein. The delivery compartment 500 may be configured as an interior door of a home (e.g., a door for positioning or placement along an interior wall of a home). The delivery compartment 500 may be configured as an exterior door of a home (e.g., a door for positioning or placement along an exterior wall of a home). An exterior door may exhibit one or more differing characteristics from an interior door, such as being made from different materials, having different weatherproofing, having different sound-proofing, etc. The delivery compartment 500 may have an appearance similar to or the same as one or more other doors associated with a home. For example, if the delivery compartment 500 is configured as an interior door, it may have a similar appearance to other interior doors of the home, such as closet doors, bedroom doors, or bathroom doors. In certain embodiments, the delivery compartment 500 may also or alternatively have an appearance similar to cabinetry, furniture, or other themes of the home.

As previously discussed, the delivery compartment 500 may provide different or selectable access to one or more users. For example, the delivery compartment 500 may have a first perimeter or border 503 and a first set of hinges (501, 502). A user may interact with a first doorknob, handle, or other opening component 505 in order to cause the first perimeter or border 503 of the delivery compartment 500 to pivot, rotate, or otherwise move via the first set of hinges (501, 502). For example, such interaction may cause the delivery compartment 500 to open and provide access to an interior of a home that the user may then pass through. The delivery compartment 500 may also have a second perimeter or border 513 and a second set of hinges (511, 512). The user may interact with a second doorknob, handle, or other opening component 515 in order to cause the second perimeter or border 513 of the delivery compartment 500 to pivot, rotate, or otherwise move via the second set of hinges (511, 512). For example, such interaction may cause the delivery compartment 500 to provide access to an interior cavity 500 for storage of goods but not provide access to the interior of the home. As discussed, access may be authorized or denied based upon credentials or other qualifications setup for the user. Different access may be allowed as between opening of the first perimeter or border 503 and the second perimeter or border 513.

Figure 6:
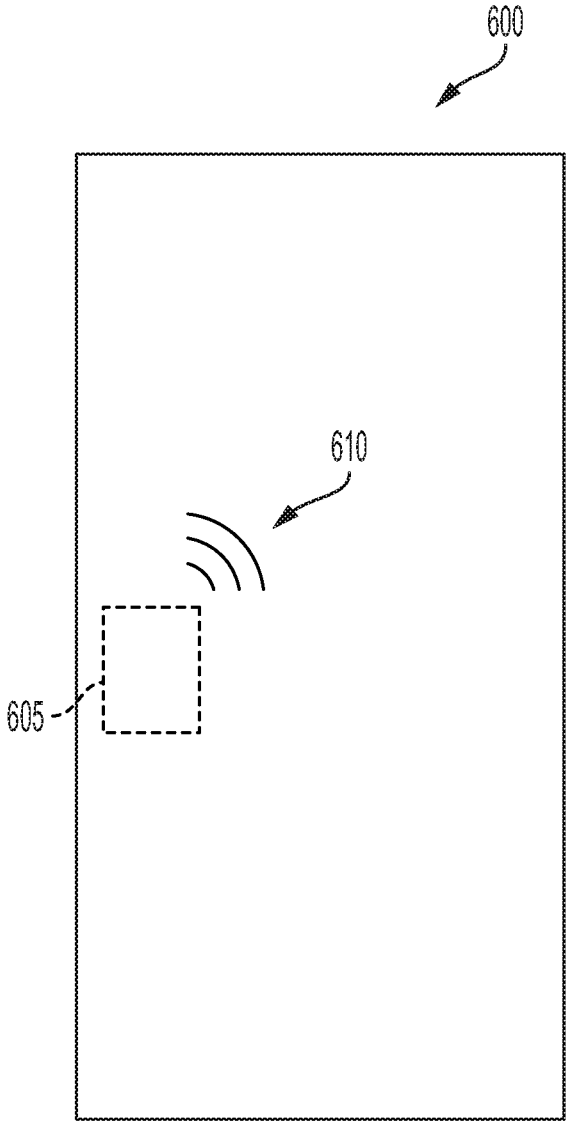
FIG. 6 illustrates an exemplary delivery compartment according to embodiments described herein.

FIG. 6 illustrates an exemplary embodiment of a delivery compartment 600 that is associated with a door. The delivery compartment 600 may include features that are the same as or similar to those previously discussed, such as the delivery compartment 204, 304, 400, and/or 500, according to embodiments described herein. As shown, the delivery compartment 600 may have an appearance of an exterior or interior wall of a home and not be readily identifiable as a delivery compartment that is associated with a door. It may therefore not have the conventional attributes of a door, such as a handle or visual lock. The delivery compartment 600 may, in certain embodiments, have other features or appearances corresponding to other features of the home, such as a door, shutter, window, etc.

The delivery compartment 600 may be opened in any number of ways. For example, the delivery compartment may include a door or panel that includes a push release that secures the door or panel in a closed position when the door or panel is pressed into position, and then released when the door or panel is pressed again. The door or panel may be opened through an input from a user (e.g., through an input device), such as through a button, or other release mechanism, either physically located on or adjacent the delivery compartment 600, or remote from the delivery compartment 600. The button may be, for example, integrated into a doorbell. The door or panel may be opened through entry of an access code. The access code may be entered through a keypad associated with the delivery compartment 600 and/or via a mobile device or other electronic device configured to wirelessly communicate 610 with control componentry 605 corresponding to the delivery compartment 600 and/or a system configured to control the delivery compartment 600. The door or panel may be opened through a detection of a device, such as a key fob, or wireless signal sent by and received from a wireless device.

Figure 7:
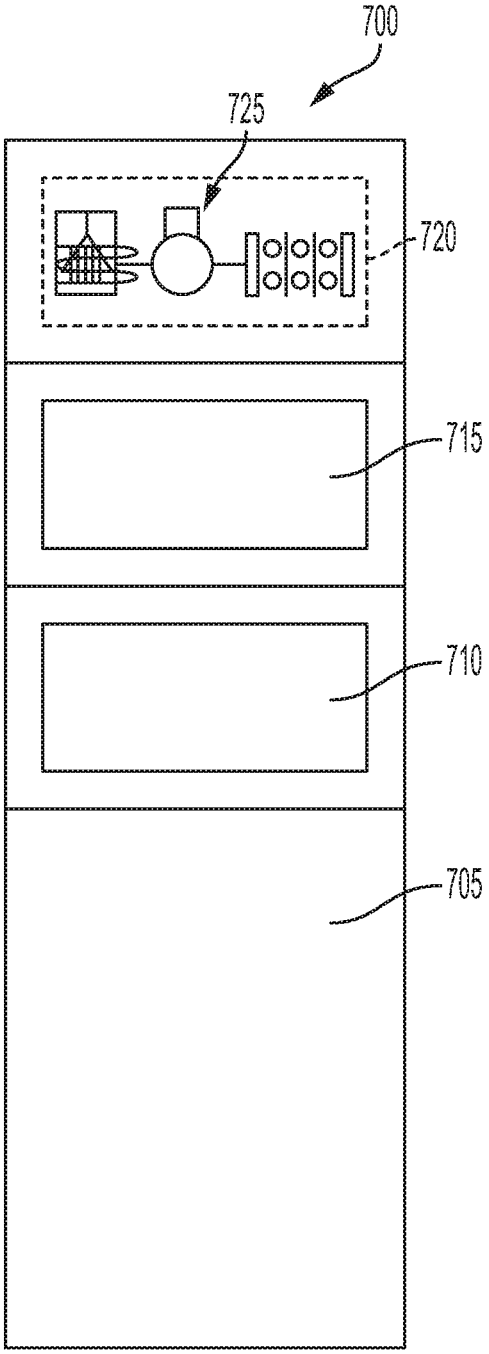
FIG. 7 illustrates an exemplary delivery compartment according to embodiments described herein.

FIG. 7 illustrates an exemplary embodiment of a delivery compartment 700 according to embodiments described herein. The delivery compartment 700 may include features that are the same as or similar to those previously discussed. The delivery compartment 700 may include a plurality of separate cavities or spaces to facilitate drop off of different deliveries. In an exemplary embodiment, the cavities may define different interior sizes and/or may be segregated or separate from one another. In an exemplary embodiment, the cavities may be separately opened and closed or may be opened or closed as a group. For example, the cavities may have respective doors and/or separately openable portions of a door or panel to provide individual access to each cavity separate from the other of the cavities. The separate cavities may have different characteristics, which may facilitate deliveries of different types or deliveries of items benefiting from different storage characteristics.

The delivery compartment 700 may include an area 720 or cavity for containing one or more environment control components and/or other electronics or mechanical components 725, such as, for example, components to control temperature and/or humidity (e.g., to create a refrigerated and/or freezer cavity within one or more cavities, as discussed in greater detail below. The environment control components and/or electronics or mechanical components 725 may control refrigeration to cause one or more cavities of the delivery compartment 700 to be set to a desired temperature. The environment control components and/or other electronics or mechanical components 725 may be configured to set a different temperature and/or other environmental setting for different cavities.

For example, a first cavity 705 may be provided for receipt and storage of goods or items that do not require or benefit from any additional or special handling or care instructions such that it may not have a temperature controlled by the environment control components and/or other electronics or mechanical components 725. In one embodiment, the first cavity 705 may be the largest of the plurality of plurality of cavities, for example, having dimensions of 30"×30" by 22". A second cavity 710 may be set to a temperature for refrigeration for receipt and storage of foods or goods with care or handling instructions that request the items be kept at a first refrigerated temperature. In one embodiment, the second cavity 710 may be smaller in size than the first cavity 705, for example, having dimensions of 13"×28"×22". A third cavity 715 may be set as a freezer or to a temperature different (e.g., below) the temperature for the second cavity 710 for receipt and storage of foods or goods with care of handling instructions that request the items be kept at a freezing temperature. In one embodiment, the third cavity 715 may be the same size as the second cavity, for example, having dimensions of 13"×28"×22". In alternative embodiments, any combination of cavities (of any of a variety of possible sizes, shapes, or configurations) may be created as part of the delivery compartment 700 and any of a variety of possible temperatures or other environmental controls (e.g., humidity, etc.) or other settings may be possible in one or more of such cavities that are controlled and/or monitored by the environment control components and/or other electronics or mechanical components 725. For example, in one embodiment, a single cavity or section of the delivery compartment 700 may be configured to operate as either a refrigerated section and/or a freezer section, for example, based upon user input, for example by a user setting of the desired temperature via one or more user interface devices associated with the delivery compartment 700 (e.g., a knob, button, touchscreen, etc.) and/or via remote configuration (e.g., user interaction with a smart phone, computer, mobile device, etc. that is in communication (e.g., wired or wirelessly)) with the delivery compartment 700. For example, in such an embodiment, the delivery compartment 700 may include two cavities or sections, one section used for unconditioned package delivery while the other section used for package delivery that requires refrigeration and/or freezing (e.g., controlled based upon the particular deliveries being delivered or due for delivery at particular days or times).

In an exemplary embodiment, one or more of the cavities of the delivery compartment 700 may not be fully enclosed, such as by not including a door or providing an uncovered access opening. The delivery compartment 700 may have cavities that are temperature, humidity, or otherwise controlled in its interior environment. There may be no cavities that are refrigerated, frozen, or environmentally controlled. There may be a plurality of cavities with one or more environmental condition. In certain embodiments, a user may be able to set which cavities are to be controlled in any of a variety of possible configurations, for example. Such user-configurable cavities may be set via one or more of the environment control components and electronics 725 directly, or may be set via a separate (e.g., remote) device (e.g., computer, mobile phone, etc.) that communicated (e.g., via hard-wire or wirelessly) with one or more of the environment control components and electronics 725.

In another exemplary embodiment, different cavities may be configured to be protected from subsequent access once a delivery has been made thereto. For example, if a delivery is made such that an item is delivered into the first cavity 705, the first cavity 705 may be prevented from subsequent access for additional deliveries until a particular condition has been met (e.g., a user or owner of the home accesses the first cavity and/or removes all or some of the items that had been delivered to the first cavity 705, a user or owner of the home manipulates a "clear" or "reset" switch, such as within an application for a mobile phone or via a keypad, indicating that additional deliveries to the first cavity 705 may be made, etc.). Different cavities may be separately accessed, locked, monitored, or controlled. In an exemplary embodiment, a group of cavities may be accessed, locked, or controlled together.

Access to one or more interior compartments or cavities of a delivery compartment, such as delivery compartments the same as or similar to those previously discussed may be provided in a number of different ways. As previously discussed, access may be provided to one or more interior compartments via one or more doors or opening coverings. Additionally or alternatively, access may be provided through physical rotation and/or translation of all or a portion of the delivery compartment itself.

Figure 9A:
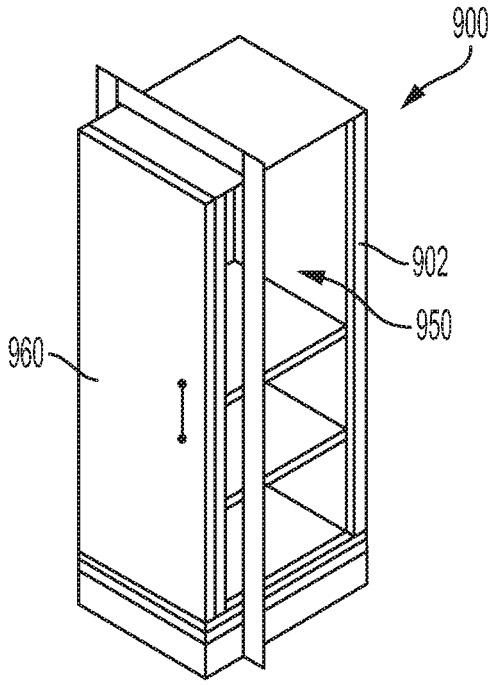
FIGS. 9A-9C illustrate perspective views in different positions or configurations of an exemplary delivery compartment according to embodiments described herein.
Figure 9C:
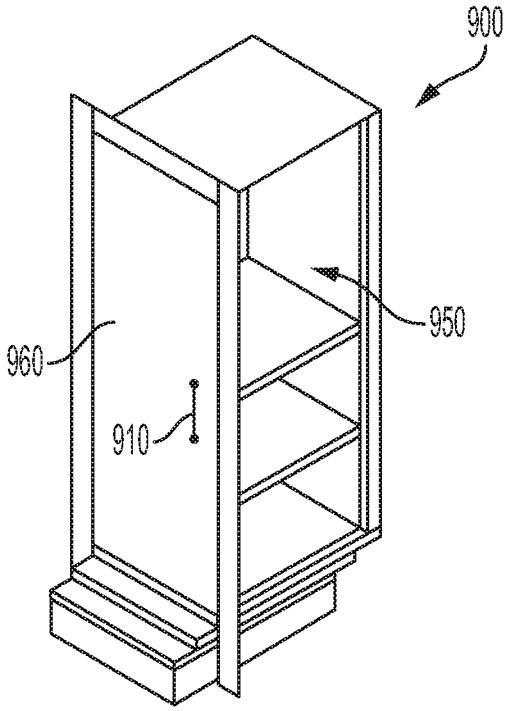
Figure 9B:
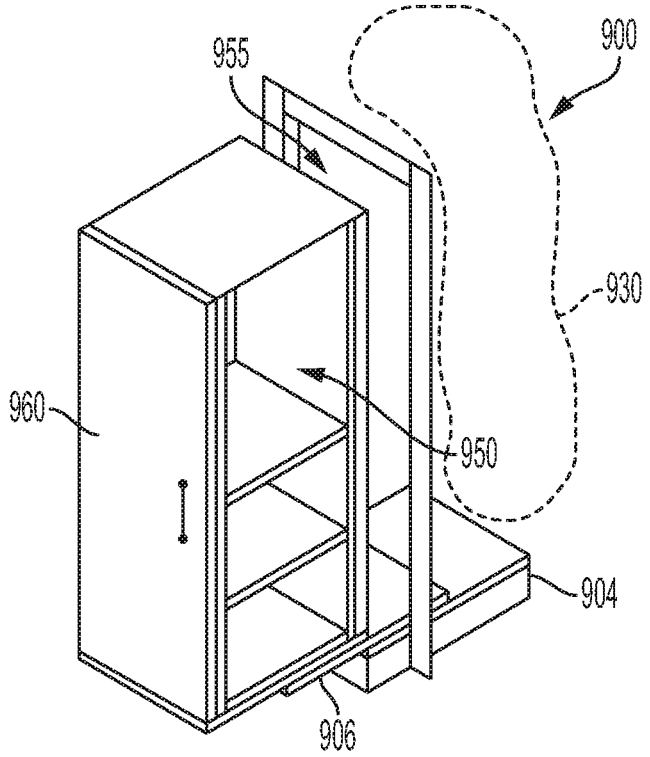

FIGS. 9A-9C illustrate an exemplary embodiment of a delivery compartment 900 which provides access to its one or more interior compartments via translation of a portion of the delivery compartment 900. Certain features of the delivery compartment 900 may be the same as or similar to those previously discussed. As shown in FIGS. 9A-9C, a portion of the delivery compartment 900 may translate directionally in and/or out of a space to provide access to one or more interior compartments or cavities of the delivery compartment 900. In the exemplary embodiment shown in FIGS. 9A-9C, one dimensional, linear motion forward and/or backward along a same path) is shown. However, an alternative embodiment may allow multi-dimensional motion and/or other forms of motion (e.g., rotational) combined with or in alternative to translational motion for permitting access to all or some of the interior compartments or cavities of the delivery compartment 900.

As shown, in an exemplary embodiment, the delivery compartment 900 may include a base 904 (e.g., stationary and/or secured) and a structure or frame 902 containing an interior cavity 950 that is separated into one or more compartments. The structure or frame 902 may couple (e.g., some portion may be received by or otherwise interface) with the base 904. An area of open space 930 positioned adjacent (e.g., above) the base 904 permits the structure or frame 902 to be partially or fully received therein. The open space 930 may be formed from a structure separate from a home or building (e.g., a metal, wood, or other material structure built to enclose the structure 902 and coupled with a home, apartment, condo, office complex, lobby etc.). In another embodiment, the open space 930 may be a part of or integrated with a home, apartment, condo, office complex, lobby, etc. (e.g., built into a frame or wall). In one embodiment, the base 904 may provide support to maintain the structure or frame 902 in a particular position (e.g., upright) or configuration. The structure or frame 902 may be permitted to rotate or translate (e.g., slide, roll, or otherwise move) with respect to the base 904 for permitting access to the one or more compartments of the structure 902.

In one embodiment, the base 904 may be weighted and/or may be integrated or coupled with a securing element (e.g., a wall of a home, foundation, frame of a structure, building, item of furniture, etc.). The base 904 and/or the structure of frame 902 may include, incorporate, or use one or more mechanical features, such as, for example, fasteners, runners, tracks, slide, wheels, casters, roller, hinge, bearings, etc. to aid in providing translational (or other) relative movement of the structure or frame 902 relative the base 904. The base 904 may be positioned under the structure or frame 902, on a side of the structure or frame 902, above the structure or frame 902, or otherwise adjacent to the structure or frame 902, and/or any combinations thereof.

The delivery compartment 900 of FIGS. 9A-C may be configured such that the delivery compartment 900 has a first configuration in which the structure or frame 902 is fully translated in a first direction as permitted by the components used (e.g., the structure or frame 902 is fully received or engaged with by the base 904 and/or the open space 930), such as illustrated in FIG. 9C. In such a first configuration, an exterior edge and/or component 910 (e.g., a handle) of the structure or frame 902 is accessible (e.g., may be manipulated by a user in order to change the delivery compartment 900 to a different configuration). By manipulating the exterior edge and/or component 910, the delivery compartment 900 may be modified to a second configuration in which the system is fully translated in a second direction (e.g., the structure 902 is not fully received by the base 904 and/or the open space 930, as seen in FIG. 9B). The second configuration of the delivery compartment 900 may have one or more of the compartments of the interior cavity 950 of the structure or frame 902 outside or partially outside of the open space 930 and available for user interaction.

In an exemplary embodiment, a side or surface 960 of the delivery compartment 900 may be configured to cover all or a substantial portion of an opening 955 for the open space 930 when the delivery compartment 900 is in the first configuration (e.g., as shown in FIG. 9B). In an exemplary embodiment, the opening providing access to the interior cavity 950 and the opening 955 leading to the open space 930 may be contained in perpendicular planes (e.g., as shown in FIG. 9B). Access may be provided to the opening of the interior cavity 950 as the structure or frame 902 is extended at least partially out of the open space 930. The interior cavity 950 may be accessed through a first side of the structure or frame 902, a second side of the structure or frame 902, a third side of the structure or frame 902, and/or any combinations thereof. For example, as shown, in FIG. 9C, access to the interior cavity 950 may be made through an opening on the side of the structure 902, where the opening is in a plane parallel to the translational direction of the structure 902. Access may also be provided on an opposing side or may be through an openable panel on the front face of the structure 902, thereby providing access to the recess or interior locations of the interior cavity 950.

Any of a variety of possible components may be used for allowing the delivery compartment 900 to change between the first configuration and the second configuration. For example, as illustrated in FIG. 9B, the structure or frame 902 may include one or more plates 906 for allowing translational movement of the structure or frame 902 relatives to the base 904. In one embodiment, the one or more plates 906 may include one or more mated mechanical features for pairing with one or more mechanical feature of the base 904 (such as, for example, mechanical fasteners, runners, tracks, slide, wheels, casters, roller, hinge, etc.). In an alternative embodiment, any other components and or methods may be used to allow the delivery compartment 900 to change between the first configuration and the second configuration, whether via translational movement, rotational movement, or any other type of movement or modification.

Figure 10:
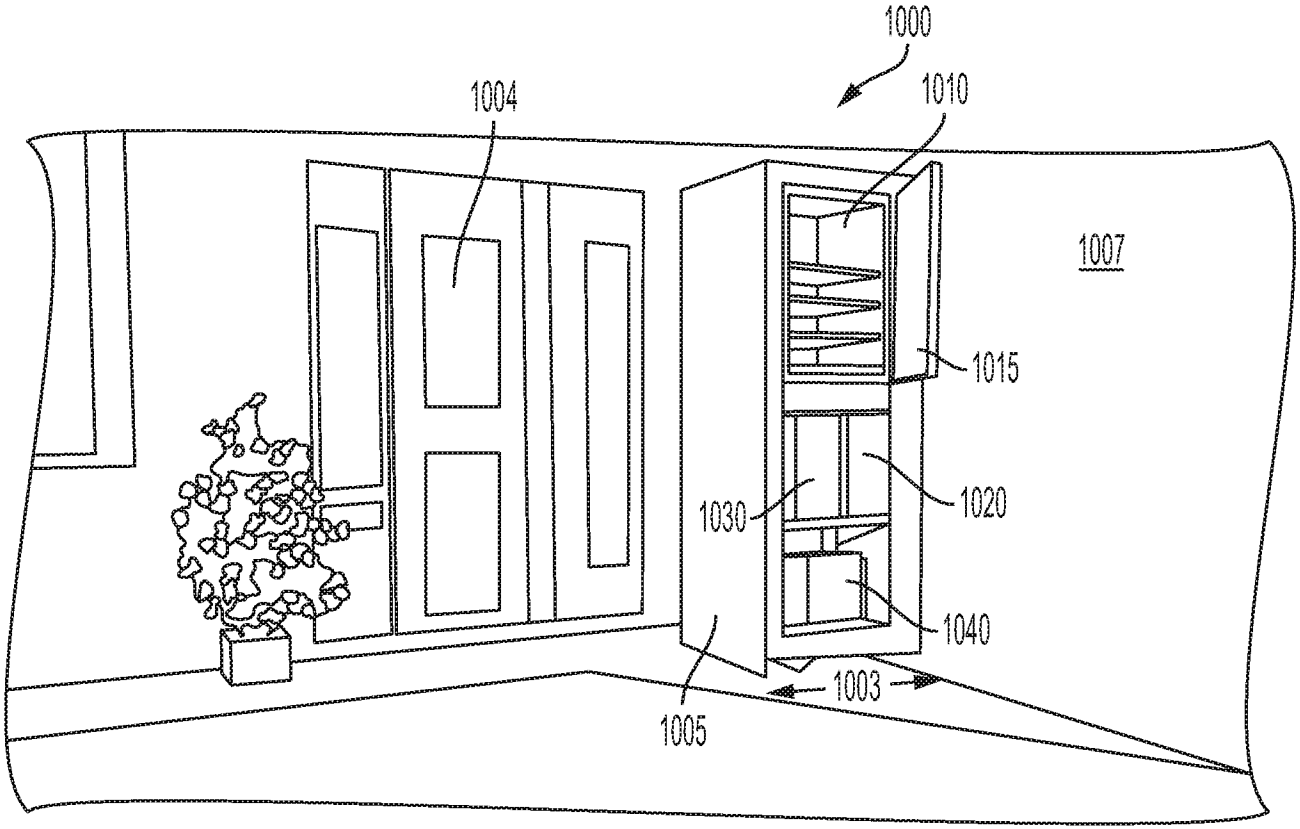
FIG. 10 illustrates an exemplary delivery compartment integrated into a building accordingly to embodiments described herein.

FIG. 10 illustrates an exemplary embodiment of a delivery compartment 1000 according to embodiments described herein. The delivery compartment 1000 may include features that are the same as or similar to those previously discussed. The delivery compartment 1000 may be positioned or disposed adjacent to a door 1004 leading to access to a building. As shown, an exterior side 1005 of the delivery compartment may be configured to appear as a wall of an exterior side of a home or building. The delivery compartment 1000 may be configured to translate or move 1003 into and out of a wall 1007 of a home or other building or structure. When translated out of the wall 1007, an opening providing access to one or more interior cavities (1010, 1020, 1030, 1040) is exposed and accessible. The delivery compartment 1000 may include one or more additional doors (e.g., door 1015) to cover and/or open or close for providing access to one or more of the interior cavities (1010, 1020, 1030, 1040). The one or more interior cavities (1010, 1020, 1030, 1040) may include features the same as or similar to those previously described (e.g., may be environmentally controlled or otherwise be monitored). In an exemplary embodiment, access to the delivery compartment may be according to methods and systems described herein, such as through locks, push buttons, intercom, keys, push interface, etc. The system may be configured to translate the delivery compartment to provide access when encountering any of the access methods described herein, such as for use with a lock.

Alternative embodiments may include additional or fewer features, in the same or alternative configurations. For example, in one embodiment of the invention, an interior release, button, latch, or other device may be included or associated with a delivery compartment for allowing unlocking, releasing, and/or opening of the compartment if a child or other individual gets stuck and/or locked inside of the delivery compartment. Such a feature may be desirable even if the delivery compartment has remote unlocking capabilities in circumstances where an individual is stuck within the delivery compartment and wishes to exit, but does not wish to wait for another individual to notice that they are locked within or that there is some need to unlock or open the delivery compartment. The interior release, button, latch, or other device may be manipulatable only from within the delivery compartment when the delivery compartment is in a closed configuration in order to prevent unauthorized access to the interior cavities of the delivery compartment from outside of the delivery compartment. In certain embodiments, when the interior release, button, latch, or other device is manipulated, and/or when the delivery compartment is opened (e.g., upon immediate opening and/or upon the delivery compartment being opened for a predetermined amount of time), a notification or other signal may be communicated in response (e.g., to a connected software application or other hardware), indicating that the interior release, button, latch, or other device had been used and/or the delivery compartment had been opened.

Figure 11A:
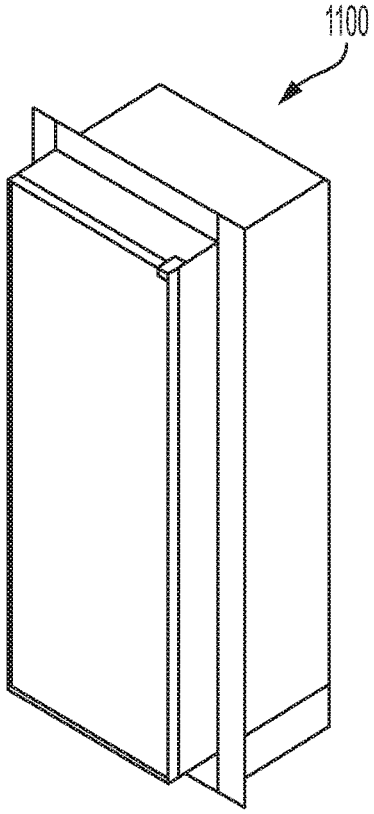
FIGS. 11A-11B illustrate perspective views in different positions or configurations of an exemplary delivery compartment according to embodiments described herein.
Figure 11B:
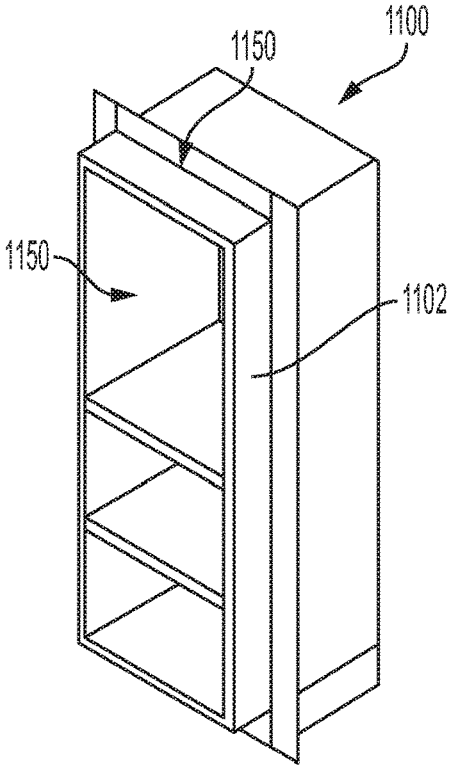

FIGS. 11A-11B illustrates an exemplary embodiment of a delivery compartment 1100. The delivery compartment 1100 may include features that are the same as or similar to those previously discussed. For example, the delivery compartment 1100 may be similar to the delivery compartment 900 of FIGS. 9A-9C, but the delivery compartment 1100 may have a different orientation such that an opening providing access to an interior cavity 1150 of the delivery compartment is turned 90 degrees when compared to delivery compartment 900 and is parallel to a second opening (covered by a frame 1102 in FIG. 11B) that provides access to an open space for receipt of all or a portion of the frame 1102 of the delivery compartment 1100 during its movement (e.g., into or out of a wall). The delivery compartment 1100 may or may not translate to provide access in alternative embodiments. The delivery compartment 1100 may be configured such that its component parts are modular, and a different or the same base may be used to permit or prevent translation depending on the desired construction of the particular installation.

Figure 12:
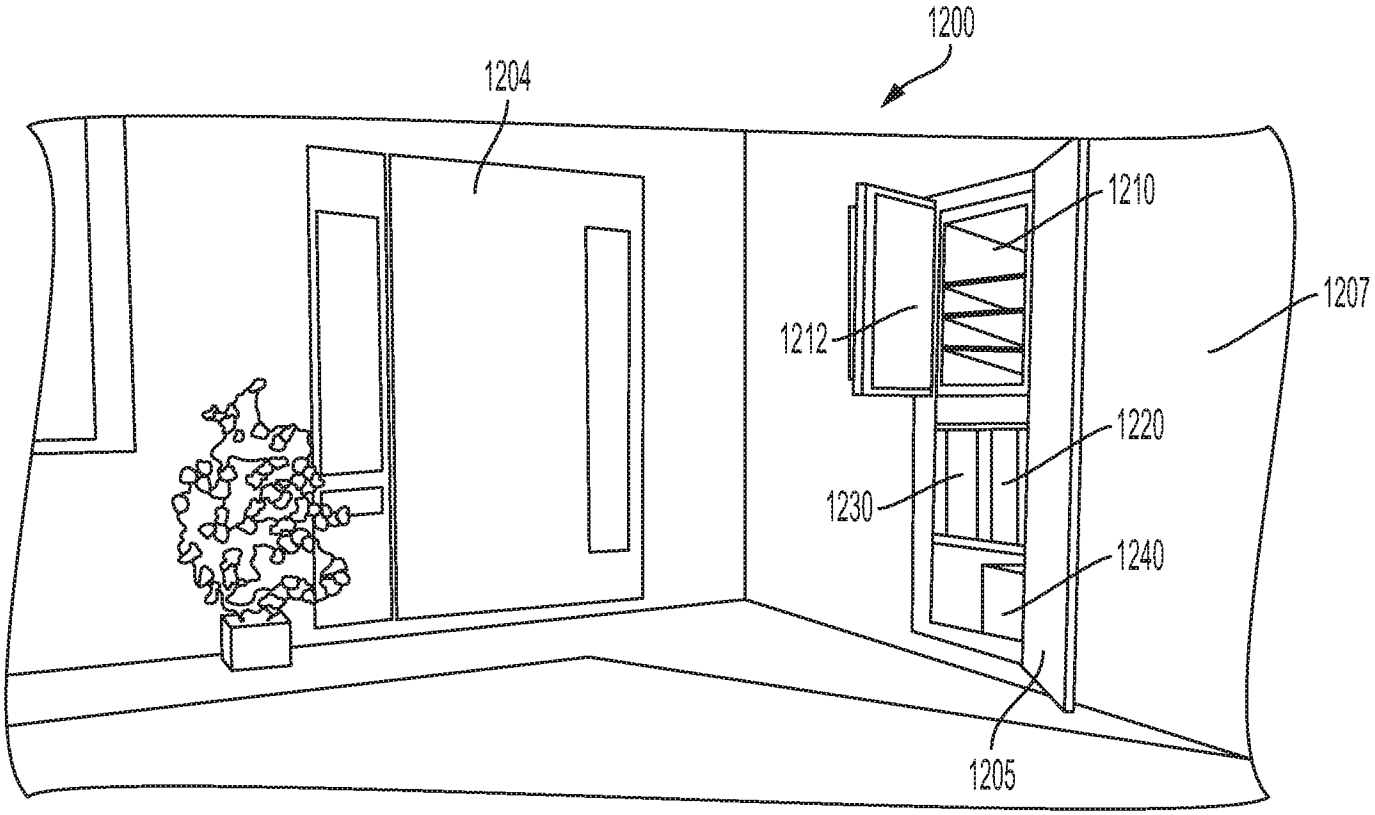
FIG. 12 illustrates an exemplary delivery compartment integrated into a building accordingly to embodiments described herein.

FIG. 12 illustrates an exemplary embodiment of a delivery compartment 1200 according to embodiments described herein. The delivery compartment 1200 may include features that are the same as or similar to those previously discussed. The delivery compartment 1200 may be positioned or disposed adjacent to a door 1204 leading to access to a building. As shown, a panel or door 1205 may be configured to open or close for providing access and may be configured to resemble a wall 1207 for hiding the existence of the delivery compartment 1200 when closed or otherwise making the delivery compartment more visually pleasing. The delivery compartment 1200 may be stationary and not configured to translate or move into and out of the wall 1207. The delivery compartment 1200 may include one or more additional doors 1212 to cover and/or open or close for providing access to one or more interior cavities (1210, 1220, 1230, 1240). The one or more interior cavities (1210, 1220, 1230, 1240) may include features the same as or similar to those previously described (e.g., may be environmentally controlled or otherwise be monitored). In an exemplary embodiment, access to the delivery compartment may be according to methods and systems described herein, such as through locks, push buttons, intercom, keys, push interface, etc. The system may be configured to translate the delivery compartment to provide access when encountering any of the access methods described herein, such as for use with a lock.

In various embodiments, such as those previously discussed, a delivery compartment may be modular, for example, to permit design changes between embodiments described herein. For example, a door having a hinge (e.g., as shown and described for FIG. 12) may be manufactured in a modular fashion such that the door having a hinge may be replaceable with or may be secured to create a side panel configuration (e.g., as shown and described for FIG. 10). In another example, one or more bases (e.g., base 904) may be replaced or interchanged with a base that provides a differing type of movement for providing access to interior compartments or cavities of the delivery compartment (e.g., rotational and/or stationary in place of translational movement). In one embodiment, movement or rotation that is capable for a delivery component may be locked or otherwise secured such that a same or similar base may be used for either configuration.

Figure 13A:
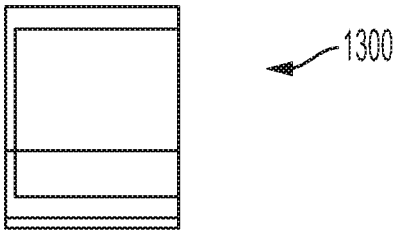
FIGS. 13A-D illustrate schematic illustrations from different view of an exemplary delivery compartment according to embodiments described herein.
Figure 13B:
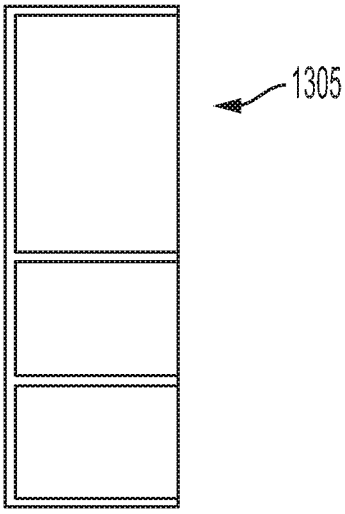
Figure 13C:
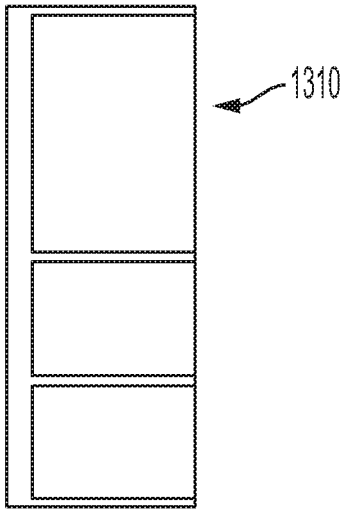
Figure 13D:
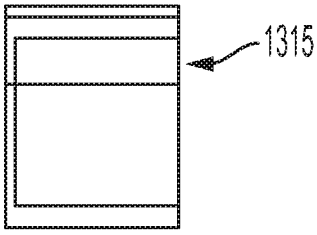
Figure 14A:
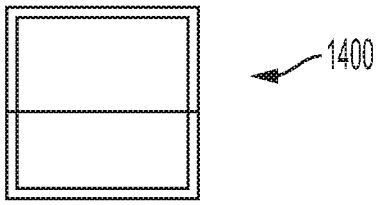
FIGS. 14A-D illustrate schematic illustrations from different view of an exemplary delivery compartment according to embodiments described herein.
Figure 14B:
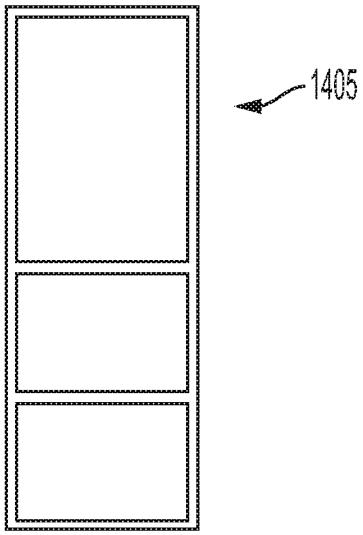
Figure 14C:
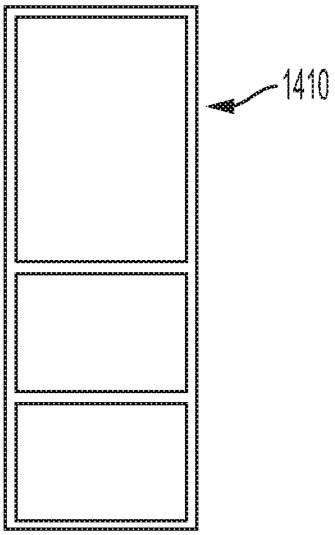
Figure 14D:
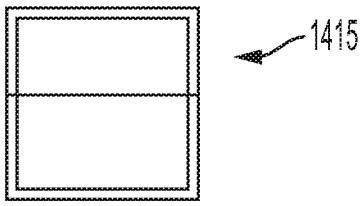

Any of a variety of shapes, dimensions, or other configurations for a delivery compartment having certain features disclosed herein may be accomplished in alternative embodiments from those explicitly illustrated. For example, FIGS. 13A-D illustrate a delivery compartment from a top perspective 1300 (FIG. 13A), a front perspective 1305 (FIG. 13B), a side perspective 1310 (FIG. 13C), and a bottom perspective 1315 (FIG. 13D). As shown, the delivery compartment has an open end (e.g., see right-most side of the top perspective 1300) that is not covered by a panel or other barrier (e.g., wall or frame) and provides immediate access to one or more of the interior cavities of the delivery compartment. Such a shape, dimension, or other configuration for the delivery compartment of FIGS. 13A-D may be used in a delivery compartment that translates, rotates, or otherwise moves in and out of a space (e.g., within a wall). In this fashion, the immediate access to the one or more of the interior cavities of the delivery compartment is protected by first having to position the delivery compartment in an accessible position (e.g., translated out of the space), which may first require authorization.

FIGS. 14A-D, however, illustrate a delivery compartment from a top perspective 1400 (FIG. 14A), a front perspective 1405 (FIG. 14B), a side perspective 1410 (FIG. 14C), and a bottom perspective 1415 (FIG. 14D) where the delivery compartment has doors or barriers on its sides (e.g., see the top perspective 1400), one or more of which must be opened in order to provide access to the interior cavities of the delivery compartment. Such a shape, dimension, or other configuration for the delivery compartment of FIGS. 14A-D may be used in a delivery compartment that is stationary and does not need to translate, rotate, or otherwise moves in and out of a space (e.g., within a wall). One or more of the doors or barriers may be protected by first requiring authorization before opening. In an alternative embodiment, any combination of shape, dimension, and/or configuration may be used.

In various embodiments, such as those previously discussed, a delivery compartment may be configured to be selectively unlocked and/or opened (e.g., remotely by a user). In one embodiment, a mechanism may be provided that may communicate (e.g., wired or wirelessly) with a door and/or lock of the delivery compartment in order to selectively permit access to an interior cavity of the delivery compartment to allow delivery and/or pickup. The mechanism may include a lock on one or more of the doors to the delivery compartment. In one embodiment, the mechanism, lock and/or door may be permit access via one or more of a physical key, key code, biometric identification, or other authorizing signal (e.g., RFID). In one embodiment, the mechanism may be programmed to be automatically opened during an entered delivery time. For example, a user may program the lock directly or through an application communicatively coupled and capable of controlling and/or programming the mechanism such that the mechanism causes the door and/or lock to normally be in a locked configuration preventing access to one or more interior cavities of the delivery compartment, but to change to an unlocked configuration during an expected or predetermined delivery window or in response to a stimulus (e.g., a signal sent indicating delivery is imminent, for example, generated by a delivery courier).

In an exemplary embodiment, the lock may be in a normally unlocked configuration. Once a delivery is made, or one or more items are detected within the delivery compartment, the system may change the lock to a locked configuration. The system may detect the presence of a delivered package, such as by a camera on an interior of the compartment or by sensing a weight within the compartment, or simply by detecting the opening and closing of the exterior door. If the delivery compartment is determined to be in an "in use" condition such that a delivery is presumed or detected to be inside, the lock changes configuration to a locked configuration. The delivery compartment may stay in a locked configuration until the compartment is determined to be in an "empty" condition, such as by detecting the removal of the delivery by the opening of the interior door (or exterior door again), by receiving an unlock request for the door, or through detection by a camera or sensor within the compartment. Any sensor may be used to detect the presence or absence of a delivery, such as, optical sensor, laser, camera, weight, or combinations thereof.

In an exemplary embodiment, a key for locking or unlocking a lock associated with a delivery compartment may be a programmed code that a user may set upon each use and provided to delivery personnel before the delivery is expected. The code may be randomly generated when a delivery is expected and provided to the resident by the delivery compartment to give to the delivery personnel or may be programmed by the resident for each use and provided to the delivery personnel. In an exemplary embodiment, different cavities may be programmed with different codes such that different delivery personnel may deliver to the home and have access to their own delivery cavity. In an exemplary embodiment, different delivery personnel may be assigned their own delivery code that does not need to be repeatedly provided to the delivery personnel. For example, if a user is expecting a package, the system may permit access to an access code provided to or used by personnel associated with the delivery of that particular package.

In an exemplary embodiment, the key may be through an application and provided remotely by the resident upon a request from a delivery personnel. In an exemplary embodiment, the delivery compartment may communicate with an application run on a resident's mobile device. When a delivery is requested, the delivery compartment may send a message to the resident through the application. The resident may then select entry into the delivery compartment, or into a select cavity of the delivery compartment. In an exemplary embodiment, the application may be a program stored in memory of the resident's mobile device. The processor of the mobile device executes the program and performs the functions described herein including, for example, sending and receiving information to and from the delivery compartment to control, set, or otherwise configured access to the delivery device.

Exemplary embodiments described herein may include a communication device, for example, to notify, signal, or otherwise indicate that a delivery is occurring or has occurred. In one embodiment, the communication device may include a manipulatable element or interface device (e.g., a button, switch, fingerprint sensor, etc.) that allows a courier to manipulate or otherwise interact with the element upon arrival for delivery and/or upon completion of delivery. In one embodiment, the communication device may be integrated with a doorbell, door knocker, etc. Upon manipulation or interaction with the element, a signal (e.g., auditory, visual, vibration, electronic, etc.) may be provided for signaling to an individual (e.g., homeowner, resident, etc.) that a delivery is occurring or has occurred. For example, in one embodiment, the communication device may include a camera or lens such that it may send a visual signal (e.g., video stream, photograph, animated image, etc.) that a delivery is occurring (e.g., provide a picture or video of the delivery personnel). In one embodiment, such visual or other signal may be received via an Internet webpage, notification within a software application (e.g., executed upon a smartphone or tablet). The individual may then choose to cause the delivery compartment (or some portion of the delivery compartment) to unlock and/or open in order to effectuate delivery. For example, the communication device may be configured to communicate with a software application stored and/or executed upon at least one mobile device).

Figure 15:
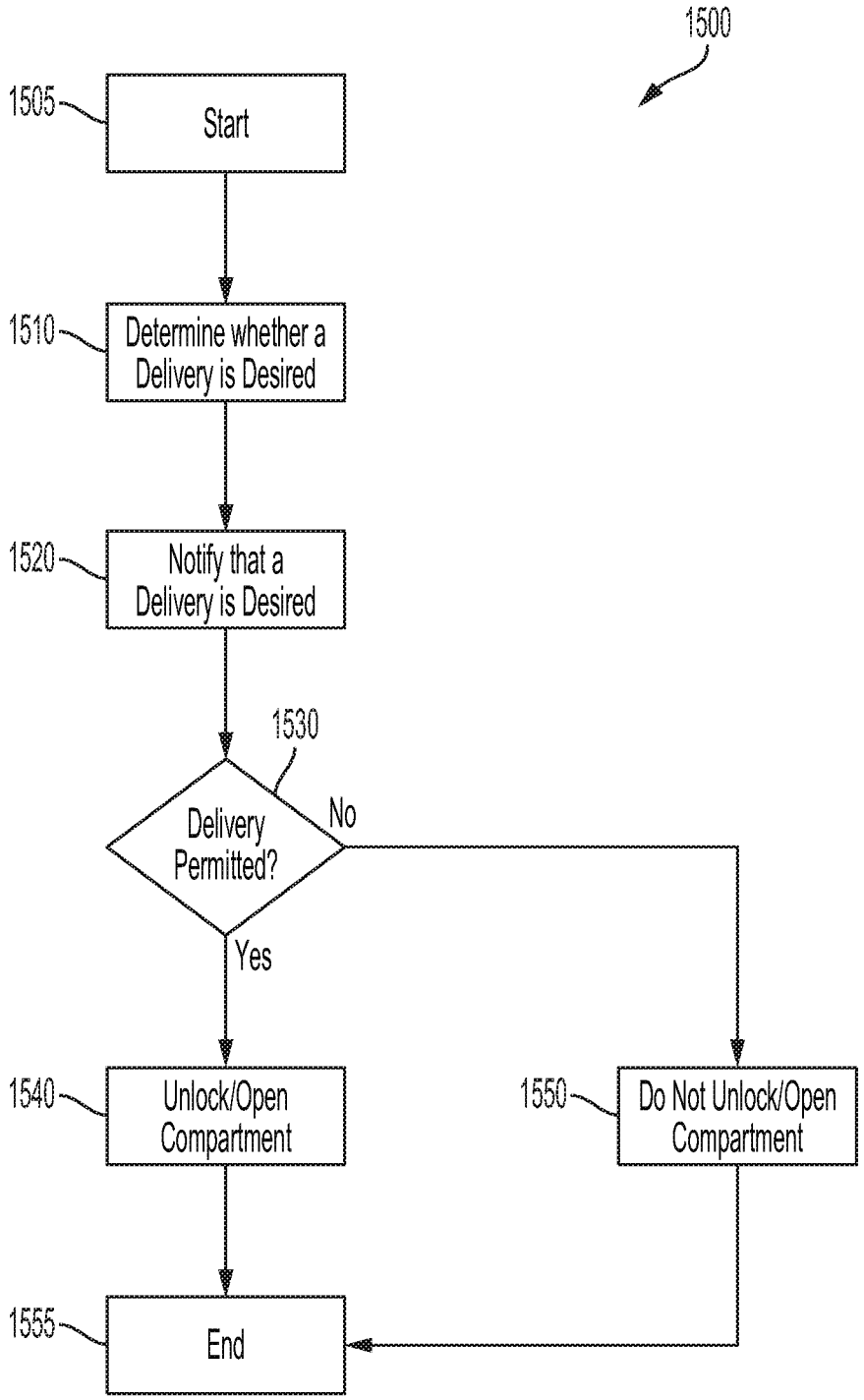
FIG. 15 illustrates a method for controlling access to a delivery compartment according to embodiments described herein.

FIG. 15 illustrates one exemplary method 1500 for locking and/or unlocking of a delivery compartment for access. At step 1505, the method starts. For example, step 1505 may include software or electronic components in a waiting state (e.g., when the delivery compartment is not in use, is empty, etc.) acid capable of receiving signals or other stimulus indicating that some different action is desired. At step 1510, it is determined whether a delivery is desired to be made to the delivery compartment. This may be accomplished via a software or electrical signal or stimulus provided and/or received to or by the software or electronic components. In another example, the signal or stimulus may be generated based upon a courier or delivery personal or equipment associated with the courier or delivery personal) (e.g., a request sent from the courier to permit delivery). In still another example, the signal or stimulus may be generated based upon other conditions not from the courier (e.g., a particular time window for delivery is established, detection of motion, detection of presence of an individual at a location, such as the front door, etc.).

At step 1520, the resident or owner of the home or building, or other individual in charge of authorizing access to the delivery compartment is notified that a delivery is desired. The notification may take any of a variety of possible forms a push notification on smart phone or other electronic device, an email, a text message, a telephone call, etc.). Multiple individuals may be configured to receive notification in certain embodiments (e.g., either simultaneously or consecutively if a particular individual does not respond to the notification to permit authorization within a predetermined or preset amount of time). At step 1530, the resident, owner, or other individual permits or denies delivery, for example, by responding to the notification (e.g., pressing a particular number on a numerical pad, pressing a user interface element in a software application, verbally indicating whether delivery is permitted, etc.).

If delivery is not permitted, operation continues to step 1550 and the delivery compartment is not unlocked or opened. A message or notification may be provided to the courier or delivery personnel that delivery has been refused or has not been authorized. This message or notification may be from a component coupled or near the delivery compartment itself (e.g., a light, a text display, a sound, etc.) and/or may be provided to a device associated with the courier or delivery personnel (e.g., a text message or other notification provided within a system used by the courier or delivery personnel). Operation then continues to step 1555 where the method ends and may be restarted by returning to step 1505. A timeout period may be established before return to step 1505 (e.g., to prevent harassment or unwanted regular notifications sent to a resident, owner, or other authorizing user).

To the contrary, if delivery is permitted via step 1530, operation continues to step 1540 and the delivery compartment is unlocked and/or opened for permitting delivery. The courier or delivery personnel may then place the package or packages within the delivery compartment and close and/or lock the delivery compartment once the packages are inside. In certain embodiments, the delivery compartment may be configured to automatically close, lock and/or other prevent access to the package within the delivery compartment upon placement of packages therein (e.g., based upon sensing a weight of the package, based upon detection of presence of the package, based upon a predetermined amount of time, etc.) for example, to aid in preventing a courier from forgetting to secure the delivery compartment after delivery. Operation then continues to step 1555 where the method ends and may be restarted by returning to step 1505 as previously discussed. FIG. 15 specifically illustrates one possible method for securing authorization of a delivery compartment, however, various other method steps may be used in addition to, or alternative to, those explicitly illustrated.

Figure 8:
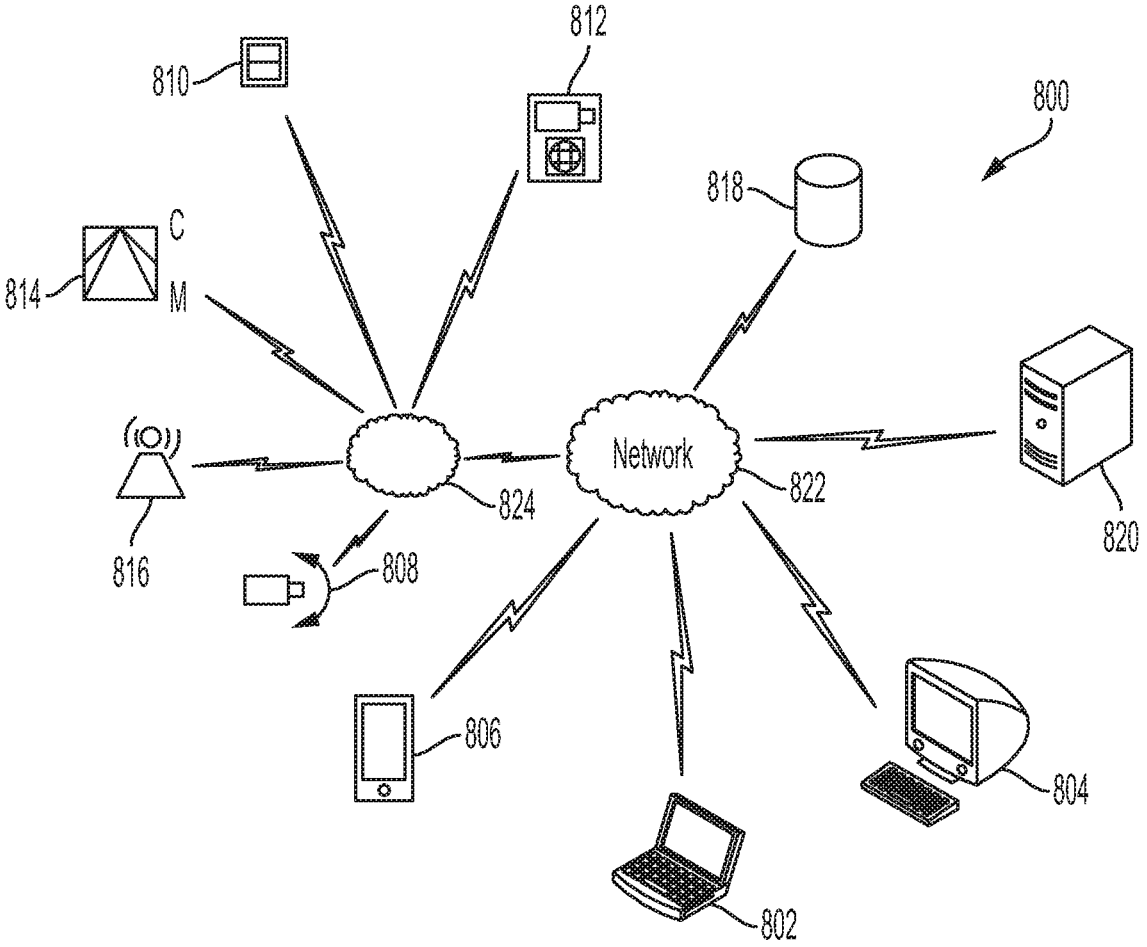
FIG. 8 illustrates an exemplary diagram of a client-server network environment to implement embodiments described herein.

For embodiments incorporating electronic (e.g., wired or wireless) control of one or more aspects of a delivery compartment, FIG. 8 illustrates one exemplary diagram of an embodiment of a client-server network environment 800 to implement one or more embodiments described herein. The network environment may be used to connect multiple devices of one or more users and/or system components. The devices may connect directly to a network 822 or through a local network or communication device 824, such as a modem. The devices may include, for example, mobile devices, such as smart phones or tablets 806, laptops 802, or other portable devices and generally non-mobile devices, such as desktop computers 804. The network 822 connects the devices to one or more servers 820 that provide information to and from the devices from a memory 818 configured to store information, such as in one or more databases. The one or more servers 820 may include one or more processors configured to communicate with memory and execute instructions stored as non-transitory machine readable code within the memory to perform functions described herein and/or control the system. Control of the system may include, for example, features previously discussed for a delivery compartment, such as providing access to a cavity of a delivery compartment (e.g., opening a door, unlocking an access area, etc.), turning on and/or off surveillance components or equipment (e.g., cameras, video, etc.), sending and receiving information, data, signals, and instructions from component parts of the system, and/or any combinations thereof.

An application resident on a client device, such as devices (806, 802, 804), or executed through a browser (e.g., an Internet web-browser) such as through devices 806, 802, 804, communicates over the network 822 with the one or more servers 820 and associated memory 818 (e.g., comprising one or more databases). One or more of the devices (806, 802, 804) may have a downloadable application running resident on the device and communicating across the network, or may execute an application through a browser scripted to run one or more programs that interact over the network.

The one or more servers 820 may receive one or more pieces of user information associated with the user and/or transaction. The server may keep a profile of the one or more pieces of data or information. One or more modules may be stored as non-transitory machine executable code on memory coupled to the network. The code may be executed by a processor to perform the functions of the module. Exemplary modules may also be any combination of hardware or software to perform the described functions.

A module, such as a client application that stored on and/or executed by one or more devices (806, 802, 804) or a server applet resident on the server 820 and run via a browser, may be configured to receive one or more pieces of information. The module may communicate over the network, such as the Internet, to the server, which stores the information in a database. One or more modules may then use the information to perform the algorithms described herein. The server applet may work with a browser application resident on the client device and serves one or more web pages to the client device with the resident browser.

Exemplary embodiments of the client-server network environment 800 may include other electronic devices, such as sensors, controllers, electronic locks, communication devices, and/or any combinations thereof. For example, the system may include one or more cameras 808, one or more signal receivers 810 (e.g., card ready, identification input, electronic input, Near Field Communication (NFC) transmitter and/or receiver, Bluetooth transmitter and/or receiver, Radio Frequency (RF) transmitter and/or receiver, infrared generator and/or receiver, optical transmitter and/or receiver, acoustic generator and/or receiver, magnetic strip reader, bar code reader, etc.), one or more communication interfaces 812 (e.g., audio communication, such as speaker and/or microphone, display screen, touch screen, etc.), one or more motion detectors 814, one or more electronic signal/communication devices 816, and/or any combinations thereof. The network environment 800 may therefore permit remote setup and/or control of such other electronic devices via devices 806, 802, and/or 804.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but may be any conventional processor, controller, microcontroller, or state machine. A processor may also be implemented as a combination of computing devices, e.g., a combination of a DSP and a microprocessor, multiple microprocessors, one or more microprocessors in conjunction with a DSP core, or any other such configuration.

The steps of a method or algorithm described in connection with the disclosure may be embodied directly in hardware, in a software module executed by a processor, or in a combination of the two. A software module may reside in RAM, flash memory, ROM, EPROM, EEPROM, registers, hard disk, a removable disk, a CD-ROM, or any other form of storage medium known in the art. An exemplary storage medium is coupled to the processor such that the processor can read information from, and write information to, the storage medium. In addition and/or the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can include RAM, ROM, EEPROM, CD-ROM or other optical disk storage, magnetic disk storage or other magnetic storage devices, or any other medium that can be used to carry or store specified program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, or wireless technologies such as infrared, radio, and microwave are included in the definition of medium. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Although embodiments of this invention have been described with reference to the accompanying drawings, it is to be noted that various changes and modifications will become apparent to those skilled in the art. Such changes and modifications are to be understood as being included within the scope of embodiments of this invention as defined by the appended claims. Exemplary embodiments are described herein including different components and features. It is understood that any embodiment may include any component or feature of any of the embodiments described herein. Accordingly, it is within the scope of the instant description to include any embodiment in any combination, and any component or feature may be added, removed, divided, integrated, duplicated, or otherwise added or removed.

What is claimed is:

1. A delivery compartment, comprising:

a base configured to be at least partially contained within a wall of a building;

a structure containing an interior cavity having a first compartment and a second compartment separate from the first compartment, the structure configured to interface with the base for moving with respect to the base, the structure having a first position wherein the interior cavity is fully contained within the wall of the building and a second position wherein the interior cavity is at least partially not contained within the wall of the building;

a first door configured to selectively permit access to the first compartment when the structure is in the second position;

a lock associated with the structure for selectively permitting the structure to be moved from the first position to the second position; and a second door configured to permit access to the first compartment or the second compartment when the structure is in the first position.

2. The delivery compartment of claim 1 wherein the structure moves with respect to the base via translation.

3. The delivery compartment of claim 1 wherein the structure moves with respect to the base via rotation.

4. The delivery compartment of claim 1 wherein the lock is configured to be remotely controlled for permitting the structure to be moved relative to the base.

5. The delivery compartment of claim 4 further comprising a button configured to be interfaced with by a user attempting delivery of an item.

6. The delivery compartment of claim 5 wherein the button is a doorbell.

7. The delivery compartment of claim 5 wherein a signal is wirelessly transmitted when the button is interfaced with by the user.

8. The delivery compartment of claim 7 wherein the signal includes at least one image taken by a camera.

9. The delivery compartment of claim 1 further comprising a button configured to be interfaced with by a user attempting delivery of an item.

10. The delivery compartment of claim 9 wherein the button is a doorbell.

11. The delivery compartment of claim 9 wherein a signal is transmitted when the button is interfaced with by the user.

12. The delivery compartment of claim 11 wherein the signal includes an image taken by a camera.

13. The delivery compartment of claim 11 wherein the signal includes a video stream taken by a camera.

14. The delivery compartment of claim 1 wherein the building is a residential building.

15. The delivery compartment of claim 14 wherein the wall of the building comprises a portion of a garage.

16. The delivery compartment of claim 14 wherein the wall is adjacent to a front door of the residential building.

17. A method for authorization by a user of delivery of a package to a building, comprising:

providing a door accessible from an exterior of the building and including an interior cavity contained fully within the boundaries of the door for the storage of the package, a barrier for selectively allowing access to the interior cavity, and a processor for controlling the access to the interior cavity by the barrier;

determining, using the processor, when delivery of the package is desired;

notifying, using the processor, the user that delivery of the package is desired;

receiving, using the processor, input from the user;

allowing access to the interior cavity of the door based upon the input from the user; and automatically preventing access to the interior cavity after the package is stored in the interior cavity of the door, wherein the door is configured to move without allowing access to the interior cavity for allowing access to an interior of the building.

18. The method of claim 17 wherein the step of notifying the user that delivery of the package is desired comprises displaying information to the user on a mobile device.

19. The method of claim 17 wherein the step of notifying the user that delivery of the package is desired comprises placing an automated telephone call to a telephone number.

20. The method of claim 17 wherein the step of notifying the user that delivery of the package is desired comprises sending a text message.

* * * * *